United States Patent [19]

Yudate et al.

[11] Patent Number: 4,578,177

[45] Date of Patent: Mar. 25, 1986

[54] METHOD FOR PRODUCING A PRECURSOR PITCH FOR CARBON FIBER

[75] Inventors: Kozo Yudate; Ken Nagasawa, both of Chiba, Japan

[73] Assignee: Kawasaki Steel Corporation, Kobe, Japan

[21] Appl. No.: 645,175

[22] Filed: Aug. 28, 1984

[51] Int. Cl.[4] ..... C10C 3/02; C10C 3/08; D01F 9/14

[52] U.S. Cl. ..... 208/45; 208/44; 208/40; 423/447.1; 423/447.4

[58] Field of Search ..... 208/45, 44, 40; 423/447.1, 447.4

[56] References Cited

U.S. PATENT DOCUMENTS

| | | | |
|---|---|---|---|
| 4,184,942 | 1/1980 | Angier et al. | 423/447.4 |
| 4,277,324 | 7/1981 | Greenwood | 208/45 |
| 4,381,990 | 5/1983 | Noguchi et al. | 208/45 |
| 4,402,928 | 9/1983 | Lewis et al. | 208/40 |
| 4,454,019 | 6/1984 | Izumi et al. | 208/40 |

*Primary Examiner*—Andrew H. Metz
*Assistant Examiner*—Helane Myers
*Attorney, Agent, or Firm*—Balogh, Osann, Kramer, Dvorak, Genova & Traub

[57] ABSTRACT

A precursor pitch suitable for production of carbon fiber which is excellent in thermal stability, spinnability, infusibility and is few in impurities, is produced by heating a coal tar pitch at a temperature of 350°-500° C. to form mesophase and extracting the thus heated pitch with a tar series light oil to obtain the precursor pitch.

3 Claims, No Drawings

METHOD FOR PRODUCING A PRECURSOR PITCH FOR CARBON FIBER

BACKGROUND OF THE INVENTION

1. Field of the Invention

The present invention relates to a method for producing a precursor pitch for carbon fiber, particularly to a method for producing a precursor pitch for carbon fiber, which is excellent in thermal stability, spinnability, infusibility and is few in impurities such as free carbon, heteroatom, inorganic substances and the like, and more particularly to a method for producing a precursor pitch for carbon fiber having a softening point of higher than 200° C., 45–60% by weight of a benzene insoluble portion, less than 0.5% by weight of a quinoline insoluble portion and less than 0.1% by weight of ash.

2. Description of the Prior Art

Heretofore, the production of carbon fibers is generally classified into a method using synthetic fibers such as polyacryl nitrile, etc. as the raw material and a method using a petroleum pitch or a coal tar pitch as the raw material in view of the raw material. The former method has the drawbacks that the raw material fiber is expensive and the carbonization yield of the raw material fiber is low. In the latter method, there is the following drawback that the pitch having a good spinnability is poor in the infusibility but the pitch having a good infusibility is poor in the spinnability. In the method for preparing the carbon fiber precursor pitch from coal tar pitch, it has been difficult to remove a fine insoluble solid component (free carbon) and inorganic substances which are dispersed in the pitch and the spinnability and the infusibility should be improved by hydrogenation by means of hydrogen gas under a high pressure or hydrogenation by means of a specific hydrogen donor.

SUMMARY OF THE INVENTION

An object of the present invention is to provide a method for producing a carbon fiber precursor pitch having excellent thermal stability, spinnability, infusibility, and high carbonization yield and containing no insoluble solid components, such as ash, free carbon and the like and sufficient strength and Young's modulus as carbon fiber, by which the above described drawbacks are obviated and the hydrogenation treatment is not necessary.

The inventors have diligently studied for attaining this object and found a method for producing the carbon fiber precursor pitch which comprises heating a coal tar pitch at a temperature of 350°–500° C. to form mesophase, extracting the thus heated pitch with an aromatic solvent to remove components insoluble in the solvent including the mesophase, removing the solvent to obtain a pitch not containing free carbon and extracting this pitch with a tar series light oil.

According to the present invention, the hard pitch for carbon fiber, which is excellent in the thermal stability, spinnability and infusibility and has a high carbonization yield can be easily produced by heat-treating a coal tar pitch to form the mesophase whereby free carbon in the pitch is readily removed, without particulary needing the hydrogenation treatment.

DESCRIPTION OF THE PREFERRED EMBODIMENTS

The invention will be explained in more detail hereinafter.

The formation of the mesophase, the growth thereof or the assembling thereof when the pitch is heat-treated, are somewhat different depending upon the kind of the pitch but the mesophase is formed at a temperature of about 350° C. and when the temperature is further raised, the formed amount increases and the mesophase is grown into large globular bodies and at about 470° C., the mesophase assembles and at about 500° C., the mesophase is wholly formed into an anisotropic body. In the course of the reaction, the free carbon of fine particles having a diameter of less than 1 μm and inorganic substances which become ash, which are originally present in coal tar pitch, stick around the mesophase globular body, so that they are easily removed.

Furthermore, high molecular weight components having a high thermal reactivity which are present in the pitch and the components having a slight amount of functional groups are preferentially polycondensed to form the mesophase, so that the pitch in which these substances are removed, lowers in the heteroatom and is very excellent in the thermal stability.

In the present invention, the pitch which has been heat-treated at a temperature from about 350° C. at which the mesophase is formed to about 500° C. at which the whole coke formation proceeds, may be used but when the temperature of the heat-treatment is high, the mesophase is formed in a large amount and as a result, the yield of the hard pitch lowers and conversely, when the temperature of the heat-treatment is low, the components having a high thermal reactivity are apt to remain in the hard pitch. When these two converse conditions are taken into account, the temperature of the heat-treatment is preferred to be one at which 10–30% by weight of the mesophase is formed.

By adding an aromatic solvent to the pitch in which the mesophase is formed by the heat-treatment under this condition, the mesophase is easily separated through spontaneous precipitation or filtration. The separation of the mesophase through the filtration does not cause clogging of the mesh of the filter different from the filtration of free carbon and is very easy. Thereafter, the solvent is removed through distillation to obtain the pitch having no free carbon and then if low molecular weight components in the pitch are removed through the heat-treatment or the solvent extraction of the pitch, the precursor pitch suitable for the raw material of carbon fiber is obtained. The properties of this precursor pitch are a softening point of higher than 200° C., a benzene insoluble portion of 45–65% by weight, a quinoline insoluble portion of less than 0.5% by weight (free carbon: trace) and ash of less than 0.1% by weight. The hard pitch having the benzene insoluble portion of less than 45% by weight is excellent in the spinnability but readily causes the fusion and stickiness of the fibers in the infusing treatment and is not preferable as the raw material for carbon fibers. When an amount of the benzene insoluble portion is more than 65% by weight, the infusibility is improved but the melt-spinning becomes difficult.

The method for preparing the carbon fiber precursor pitch from the pitch containing no free carbon includes the following means. One of these means comprises heating such a pitch at a temperature of 350°–500° C.

under a reduced pressure or while blowing an inert gas such as Ar, $N_2$, etc. to remove low molecular weight components in the pitch. If the pitch is subjected to the heat-treatment at a high temperature for a fairly long time in this course, the mesophase is again formed but the amount of the mesophase formed is preferred to be as small as possible as the carbon fiber precursor pitch and the amount is preferred to be less than 0.5% by weight. If the reformed mesophase is more than 0.5% by weight, the spinnability of the precursor pitch noticeably lowers and a large number of knots are formed in the fiber and the strength of the fiber is considerably deteriorated.

When the heat-treatment is conducted under a reduced pressure or while blowing an inert gas, it is necessary to set the heat-treating condition under which the formation of the mesophase is controlled as far as possible but the pitch according to the present invention is very excellent in the thermal stability. According to the usual vacuum distillation or the blowing of an inert gas, the precursor pitch having a benzene insoluble portion of 45–65% by weight can be produced while restraining the formation of the mesophase.

The second means comprises extracting the pitch with benzene, toluene or a tar series light oil to remove low molecular weight components in the pitch, whereby the precursor pitch is obtained. In this method, the pitch in which free carbon has been removed, is pulverized to 100 Mesh under and then low molecular weight components in the pitch are extracted and removed with a tar series light oil. As the tar series light oil, use may be made of aromatic solvents, such as benzene, toluene or tar series light oil. The solvent ratio (solvent/pitch) is 2–10 times amount, preferably 3–6 times amount and the extracting temperature is sufficient to be a temperature of lower than the boiling point of the solvent. This method wherein the solvent extraction is applied, has no fear that the mesophase is reformed different from the heat-treatment, and is a simple one.

The third means is a combination of the heattreatment with the solvent extraction. That is, the pitch containing no free carbon is heat-treated at a temperature of 350°–500° C. under a reduced pressure or while blowing an inert gas and then the thus treated pitch is extracted with a solvent of benzene, toluene or a tar series light oil to remove low molecular weight components.

The thus obtained precursor pitch having a softening point of higher than 200° C., a benzene insoluble portion of 45–65% by weight, a quinoline insoluble portion of less than 0.5% by weight (free carbon: trace) and ash of less than 0.1% by weight is excellent in the thermal stability, melt-spinnability and infusibility and a high carbonization yield.

Ash which is the impurity in the precursor pitch becomes a cause which forms voids in carbon fibers or deteriorates the strength, so that the amount of the remaining free carbon is preferred to be as small as possible but the precursor pitch according to the present invention is very clean as the ash being less than 0.1% by weight and is very excellent as the carbon fiber precursor. This precursor pitch is melt-spun at a temperature higher by 40°–50° C. than the softening point through a usual melt-spinning.

The spun fibers may be subjected to an infusing treatment according to air oxidation without effecting pretreatment by using an oxidizing agent, such as ozone oxidation or sulfuric acid. After this infusing treatment, the spun fibers are fired by raising temperature up to about 1,000° C. in an inert gas such as Ar, $N_2$ to obtain carbon fibers.

The following examples are given for the purpose of illustration of this invention and are not intended as limitations thereof.

EXAMPLE 1

Coal tar soft pitch having a softening point of 80.5° C., a benzene insoluble portion of 18.2% by weight and a quinoline insoluble portion of 3.6% by weight was heat-treated at 460° C. for 60 minutes to form about 21.8% by weight of mesophase and the thus treated pitch was extracted with tar middle oil and high molecular weight components consisting mainly of mesophase were filtered off. The filtrate was subjected to vacuum distillation (30 mmHg) at 300° C. to recover the solvent and to obtain a pitch having a softening point of 95.8° C., a benzene insoluble portion of 14.5% by weight and a quinoline insoluble portion of trace and no free carbon. This pitch was pulverized into 100 Mesh under, and purified with toluene 7 times as much as the pitch amount at room temperature and dried to obtain a precursor pitch having a benzene insoluble portion of 58.6% by weight and a quinoline insoluble portion of trace. This precursor pitch was melt-spun at 280° C. and the spun fiber was oxidized with air at 300° C. for 2 hours and subsequently carbonized in argon at 1,000° C. to obtain carbon fiber. The fiber had a fineness of 12.5 μm, a tensile strength of 81.2 kg/mm$^2$ and a Young's modulus of 3.7 t/mm$^2$.

EXAMPLE 2

The coal tar pitch in Example 1 was heat-treated at 450° C. for 60 minutes to form 18.8% by weight of mesophase. To this heat-treated pitch was added tar middle oil and high molecular weight components consisting mainly of mesophase was filtered off and the obtained filtrate was subjected to vacuum distillation (30 mmHg) to 370° C. to recover the tar middle oil and to obtain a pitch containing 24.2% by weight of benzene insoluble portion, a trace of quinoline insoluble portion and no free carbon. This pitch was pulverized to 200 Mesh under and purified with benzene 5 times as much as the pitch at room temperature and then dried to obtain a carbon fiber precursor pitch having 60.5% by weight of benzene insoluble portion and a trace of quinoline insoluble portion. This precursor pitch was melt-spun at 310° C. and then the spun fiber was subjected to an infusible treatment at 300° C. for 2 hours in air and then carbonized at 1,000° C. in argon atmosphere to obtain carbon fiber having a fineness of 12.3 μm, a tensile strength of 118.6 kg/mm$^2$ and Young's modulus of 4.9 t/mm$^2$.

EXAMPLE 3

The pitch having a softening point of 100° C. in Example 1 was subjected to vacuum distillation at 400° C. under a vacuum degree of 20 mmHgabs to obtain a pitch having a benzene insoluble portion of 42.5% by weight, a quinoline insoluble portion of trace. This pitch was pulverized to 100 Mesh under and extracted with toluene 4 times as much as the amount of the pitch at 40° C. to remove low molecular weight components, whereby a precursor pitch having a softening point of 320° C., a benzene insoluble portion of 59.7% by weight and a quinoline insoluble portion of trace. This precursor pitch was melt-spun at 345° C. and the spun fibers were oxidized with air at 300° C. for 2 hours and then carbonized at 1,000° C. in argon to obtain carbon fibers. The fibers had a fineness of 10–12 μm, a tensile strength of 148.6 kg/mm$^2$ and a Young's modulus of 6.0 t/mm$^2$.

What is claimed is:

1. A method for producing a precursor pitch for general purpose carbon fiber which comprises heating a coal tar pitch at a temperature of 350°–500° C. to form 10–30% by weight of mesophase, extracting the thus heated pitch with an aromatic solvent to separate solvent insoluble matter including the mesophase, removing the solvent from the extract to obtain a pitch containing no free carbon, and extracting this pitch with a tar series light oil to obtain a precursor pitch having a softening point of higher than 200° C., a benzene insoluble portion of 45–60% by weight, a quinoline insoluble portion of less than 0.5% by weight and ash of less than 0.1% by weight.

2. A method as claimed in claim 1, wherein the tar series light oil is benzene or toluene.

3. A method as claimed in claim 1, wherein a ratio of the solvent to the pitch is 2–10.

* * * * *